US007739846B2

(12) United States Patent
Garrett

(10) Patent No.: US 7,739,846 B2
(45) Date of Patent: Jun. 22, 2010

(54) INSULATING CONCRETE FORM BLOCK INCLUDING FOAM PANEL HAVING INNER ROW PROJECTIONS ALTERNATINGLY FLUSH WITH AND SET BACK FROM INNER EDGE AND DIFFERENT IN SIZE FROM OUTER ROW PROJECTIONS

(75) Inventor: David Michael Garrett, Oklahoma City, OK (US)

(73) Assignee: BuildBlock Building Systems, L.L.C., Oklahoma City, OK (US)

( * ) Notice: Subject to any disclaimer, the term of this patent is extended or adjusted under 35 U.S.C. 154(b) by 774 days.

(21) Appl. No.: 11/296,627

(22) Filed: Dec. 7, 2005

(65) Prior Publication Data

US 2006/0117690 A1 Jun. 8, 2006

Related U.S. Application Data

(60) Provisional application No. 60/633,779, filed on Dec. 7, 2004.

(51) Int. Cl.
*E04C 2/30* (2006.01)
*E04C 1/00* (2006.01)
*E04B 2/86* (2006.01)

(52) U.S. Cl. ..... 52/426; 52/592.2; 52/592.6

(58) Field of Classification Search ..... 52/592.6, 52/424, 442, 426, 591.3, 592.2, 591.2, 592.1, 52/592.3; 428/192
See application file for complete search history.

(56) References Cited

U.S. PATENT DOCUMENTS 1,422,258 A * 7/1922 Emery ..... 52/592.3
4,439,967 A * 4/1984 Dielenberg ..... 52/309.12
4,706,429 A * 11/1987 Young ..... 52/309.12
4,730,422 A * 3/1988 Young ..... 52/105
4,731,968 A * 3/1988 Obino ..... 52/309.12
4,866,891 A * 9/1989 Young ..... 52/105
4,884,382 A * 12/1989 Horobin ..... 52/426
4,885,888 A * 12/1989 Young ..... 52/426
4,889,310 A * 12/1989 Boeshart ..... 249/41
4,894,969 A 1/1990 Horobin
4,916,879 A * 4/1990 Boeshart ..... 52/426

(Continued)

*Primary Examiner*—Gay Ann Spahn
(74) *Attorney, Agent, or Firm*—Dunlap Codding, P.C.

(57) ABSTRACT

An insulating concrete block adapted to be interlocked with other insulating concrete blocks to form an insulating concrete form for casting concrete. The insulating concrete block including a first foam panel and a second foam panel supported in a spaced apart, parallel relationship to form a concrete receiving cavity. Each of the first panel and the second panel having a top end, a bottom end, a first end, and a second end. The top end and the bottom end of each of the first and second panels having an outside row of a plurality of projections and an inside row of a plurality of projections. The projections of the outside row being spaced apart to define a plurality of recesses and the projections of the inside row being spaced apart to define a plurality of recesses with the projections of the outside row being adjacent to the recesses of the inside row and the recesses of the outside row being adjacent projections of the inside row. At least some of the projections of the inner row are set back from an inner edge of the panel such that when one panel is interconnected with a like panel a plurality of spaced apart recesses are formed along an inner face defined by the interconnected panels.

13 Claims, 10 Drawing Sheets

U.S. PATENT DOCUMENTS 5,014,480 A 5/1991 Guarriello et al.
5,060,431 A * 10/1991 MacLeod et al. ..... 52/199
5,060,446 A 10/1991 Béliveau
5,086,600 A * 2/1992 Holland et al. ..... 52/592.6
5,123,222 A 6/1992 Guarriello et al.
5,351,455 A * 10/1994 Schoonover et al. ..... 52/410
5,390,459 A * 2/1995 Mensen ..... 52/426
5,428,933 A 7/1995 Philippe
5,459,971 A 10/1995 Sparkman
5,625,989 A * 5/1997 Brubaker et al. ..... 52/309.12
5,657,600 A 8/1997 Mensen
5,699,640 A * 12/1997 Bourgeois et al. ..... 52/309.4
5,704,180 A 1/1998 Boeck
5,809,727 A * 9/1998 Mensen ..... 52/426
5,839,243 A 11/1998 Martin
5,852,907 A 12/1998 Tobin et al.
5,896,714 A 4/1999 Cymbala et al.
6,070,380 A * 6/2000 Meilleur ..... 52/309.7
6,085,476 A * 7/2000 Jantzi et al. ..... 52/223.7
6,122,880 A * 9/2000 Kolb et al. ..... 52/592.6
6,176,059 B1 1/2001 Cantarano et al.
6,230,462 B1 5/2001 Béliveau
6,240,692 B1 * 6/2001 Yost et al. ..... 52/426
6,253,518 B1 * 7/2001 Azar ..... 52/589.1
6,253,519 B1 * 7/2001 Daniel ..... 52/591.1
6,314,694 B1 * 11/2001 Cooper et al. ..... 52/309.12
6,314,697 B1 11/2001 Moore, Jr.
6,321,496 B1 * 11/2001 Martin, Jr. ..... 52/364
6,321,497 B1 11/2001 Cormier
6,336,301 B1 1/2002 Moore, Jr.
6,398,458 B1 * 6/2002 Pacitto et al. ..... 405/286
6,401,419 B1 * 6/2002 Beliveau ..... 52/592.6
6,438,918 B2 8/2002 Moore, Jr. et al.
6,536,172 B1 3/2003 Amend
6,647,686 B2 * 11/2003 Dunn et al. ..... 52/426
6,668,503 B2 * 12/2003 Béliveau ..... 52/426
6,820,384 B1 11/2004 Pfeiffer
6,915,613 B2 * 7/2005 Wostal et al. ..... 52/426
7,024,833 B1 * 4/2006 Rice ..... 52/426
7,409,801 B2 * 8/2008 Pfeiffer ..... 52/426
2002/0092253 A1 * 7/2002 Beliveau ..... 52/426
2002/0124508 A1 * 9/2002 Dunn et al. ..... 52/426
2003/0029106 A1 2/2003 Cooper et al.
2003/0213198 A1 11/2003 Bentley
2004/0045237 A1 3/2004 Coombs et al.
2004/0045238 A1 3/2004 Dunn et al.
2005/0028466 A1 * 2/2005 Titishov ..... 52/474
2005/0223669 A1 * 10/2005 Cymbala et al. ..... 52/426
2006/0010827 A1 * 1/2006 Vanhoutte ..... 52/745.05
2007/0113505 A1 * 5/2007 Beliveau ..... 52/426
2008/0092472 A1 * 4/2008 Doerr et al. ..... 52/379

* cited by examiner

INSULATING CONCRETE FORM BLOCK INCLUDING FOAM PANEL HAVING INNER ROW PROJECTIONS ALTERNATINGLY FLUSH WITH AND SET BACK FROM INNER EDGE AND DIFFERENT IN SIZE FROM OUTER ROW PROJECTIONS

CROSS REFERENCE TO RELATED APPLICATIONS

This application claims benefit of U.S. Provisional Application No. 60/633,779, filed Dec. 7, 2004, which is incorporated herein by reference in its entirety.

BACKGROUND OF THE INVENTION

1. Field of the Invention

This invention relates generally to insulating concrete forms, and more particularly, but not by way of limitation, to an improved insulating concrete block and web therefor.

2. Brief Description of Related Art

A variety of insulating concrete form systems (also known as insulated concrete forms or blocks) exist for casting a concrete wall. Often, these systems include interlockable blocks that are formed from a pair of opposed foam panels connected together in a spaced, parallel relationship by a plurality of web members to define a concrete receiving cavity. The blocks are aligned and stacked to define a wall, and concrete is poured into the concrete receiving cavities. The blocks are maintained in place after the concrete hardens to insulate the concrete, provide a sound barrier, insulation, and serve as a backing for finishing material, such as drywall, stucco, siding, or brick.

While many of the insulating concrete form systems have met with success, problems are nevertheless encountered while fitting the blocks together, pouring the concrete into the blocks, and applying finishing materials to the formed wall. To this end, a need exists for an improved insulating concrete form that overcomes the problems experienced with use of the prior art systems. It is to such an insulating concrete form that the present invention is directed.

DETAILED DESCRIPTION OF THE INVENTION

Figure 1:
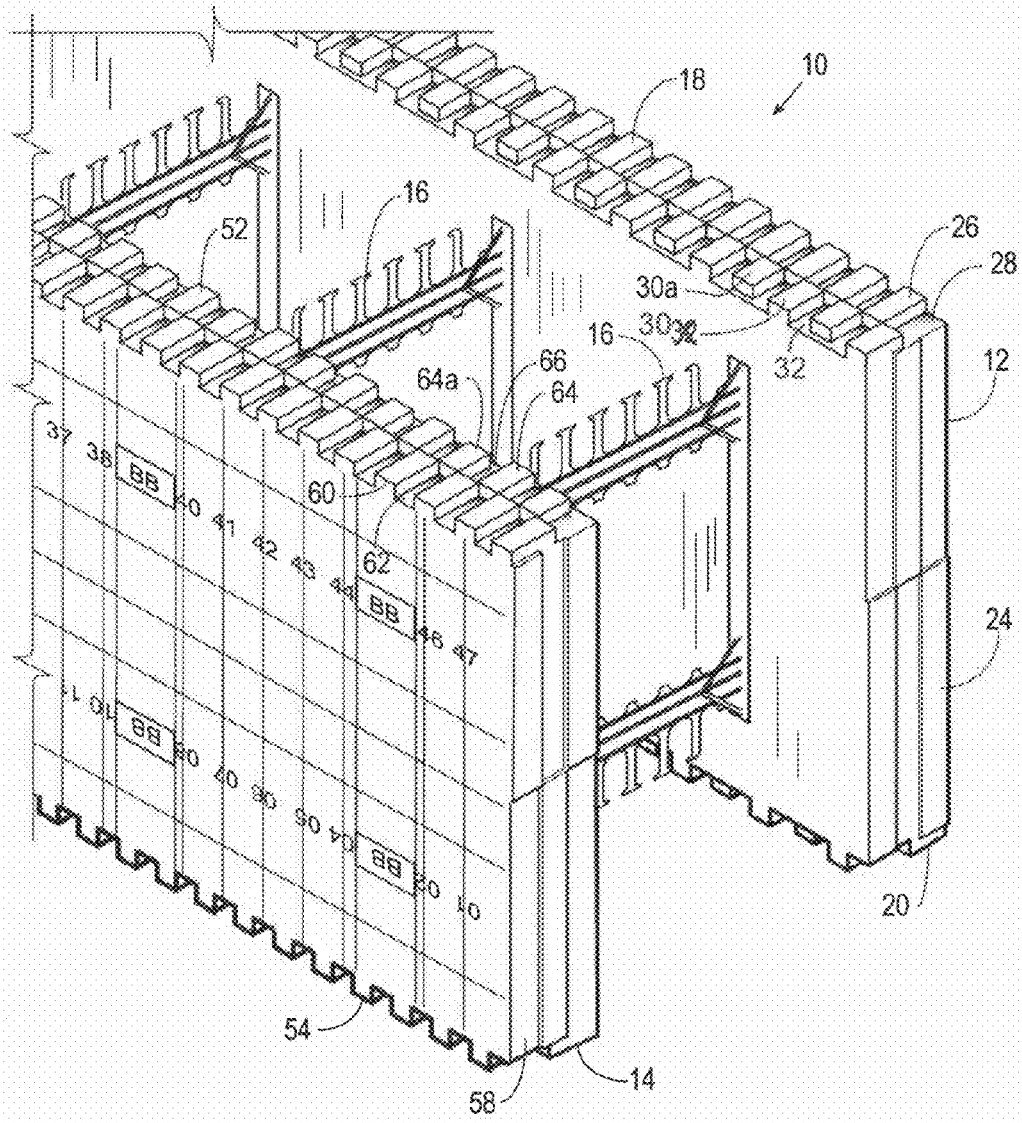
FIG. 1 is a fragmental perspective view of an insulating concrete block constructed in accordance with the present invention.
Figure 2A:
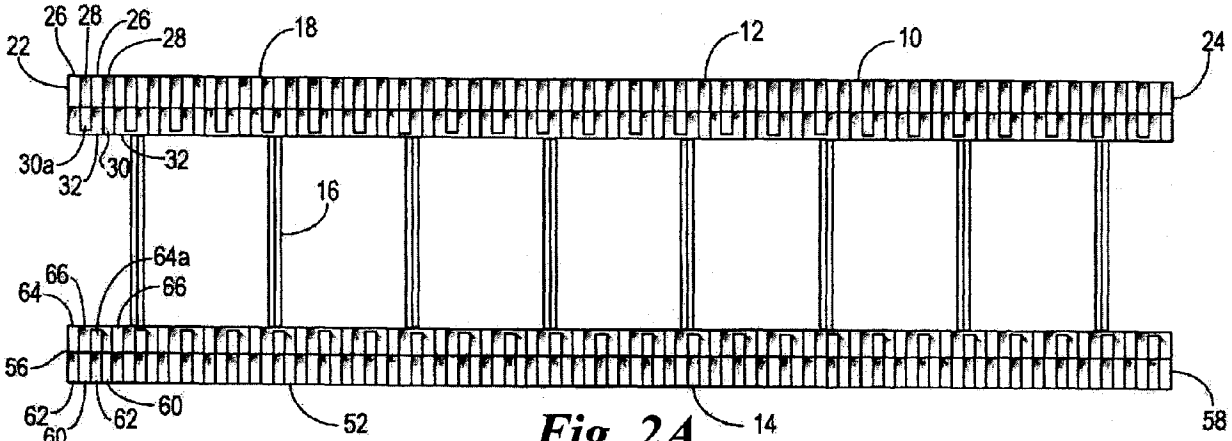
FIG. 2A is a top plan view of the insulating concrete block of the present invention.
Figure 2B:
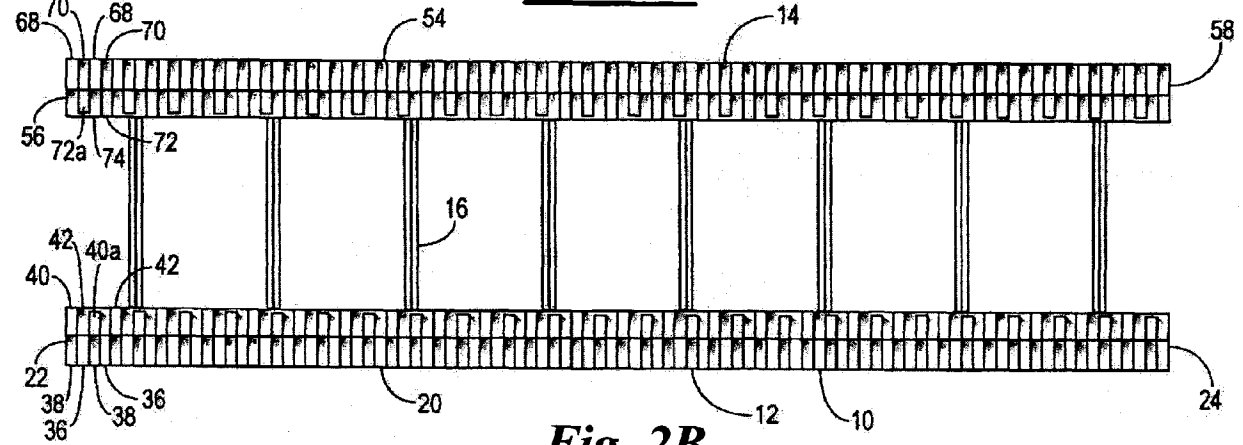
FIG. 2B is a bottom plan view of the insulating concrete block of FIG. 2A.
Figure 3A:
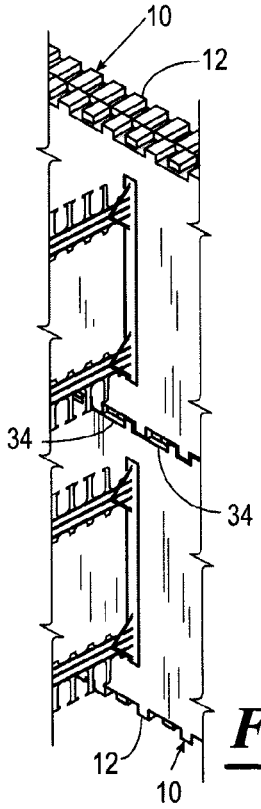
FIG. 3A is a fragmental perspective view showing two insulating concrete blocks interconnected.
Figure 3B:
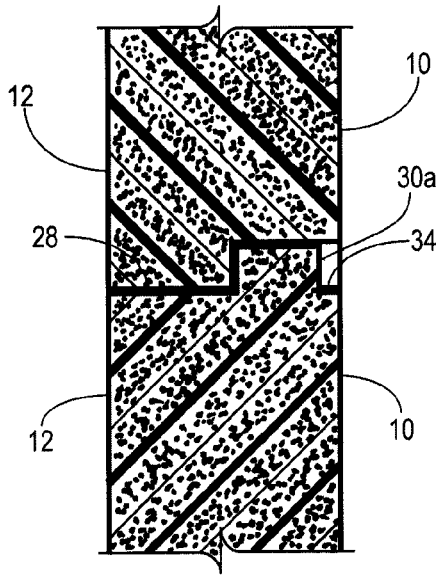
FIG. 3B is a cross-sectional view of a portion of two insulating concrete blocks interconnected.

Referring now to the drawings, and more particularly to FIGS. 1-4, an insulating concrete block 10 (referred to hereinafter as "block 10") constructed in accordance with the present invention is illustrated. The block 10 is adapted to be interlocked with other insulating construction blocks to form an insulating concrete form for casting concrete. The block 10 is formed from two panels 12 and 14 interconnected to one another with a plurality of web structures 16.

The panel 12 has a top end 18 (FIG. 2A), a bottom end 20 (FIG. 2B), a first end 22, and a second end 24. The top end 18 has an outside row of a plurality of projections 26 which are spaced apart to define a plurality of corresponding recesses 28 and an inside row of projections 30 and 30*a* which are spaced apart to define a plurality of recesses 32. The projections 30 and 30*a* of the inside row are different in size to one another and are alternated relative to one another. Moreover, the projections 30 and 30*a* of the inside row are each different in size to the projections 26 of the outside row.

By way of example, the projections 26 of the outside row may be rectangular in shape and have a dimension of approximately 1⅜ inch×½ inch×½ inch, while the recesses 28 of the outside row would be dimensioned to matingly receive a projection of such shape and dimensions. The larger inside projections 30 may be rectangular in shape and have a dimension of approximately 1⅛ inch×½ inch×½ inch, while the smaller inside projections 30*a* may be rectangular in shape and have a dimension of approximately 15/16 inch×½ inch×½ inch. The recesses 32 of the inner row are dimensioned to matingly receive either of the larger inside projection 30 and the smaller inside projection 30*a*. When the projections and recesses of the outside row and the inside row have a width of ½ inch, the panel 12 may be cut vertically at 1 inch intervals, if desired, without affecting the ability of the panel 12 to be mated with another panel 12.

Because the projections 30*a* are smaller in dimension than the projections 30, the projections 30*a* are set back from the inner edge of the panel 12. As such, when one panel 12 is stacked on another panel 12, a plurality of spaced apart recesses 34 (FIGS. 3A and 3B) are formed along the inner edge of the panel 12. During the concrete pouring process, the recesses 34 receive concrete which functions to provide additional vertical support between the blocks 10 to alleviate compression of the blocks 10 during the pumping or pouring of concrete into the blocks 10.

Similar to the top end 18, the bottom end 20 (FIG. 2B) of the panel 12 has an outside row of alternating projections 36 and recesses 38 and an inside row of alternating projections 40 and 40*a* and recesses 42. However, the projections 36, 40 and 40*a* and recesses 38 and 40 along the bottom end 20 of each panel 12 are offset relative to the top end 18 wherein a recess on the bottom end 20 opposes a projection on the top end 18 of corresponding size and a projection on the bottom end 20 opposes a recess on the top end 18 of corresponding size with the exception that the recesses of the inner rows are sized to receive either of the projections of the inner row.

Figure 4:
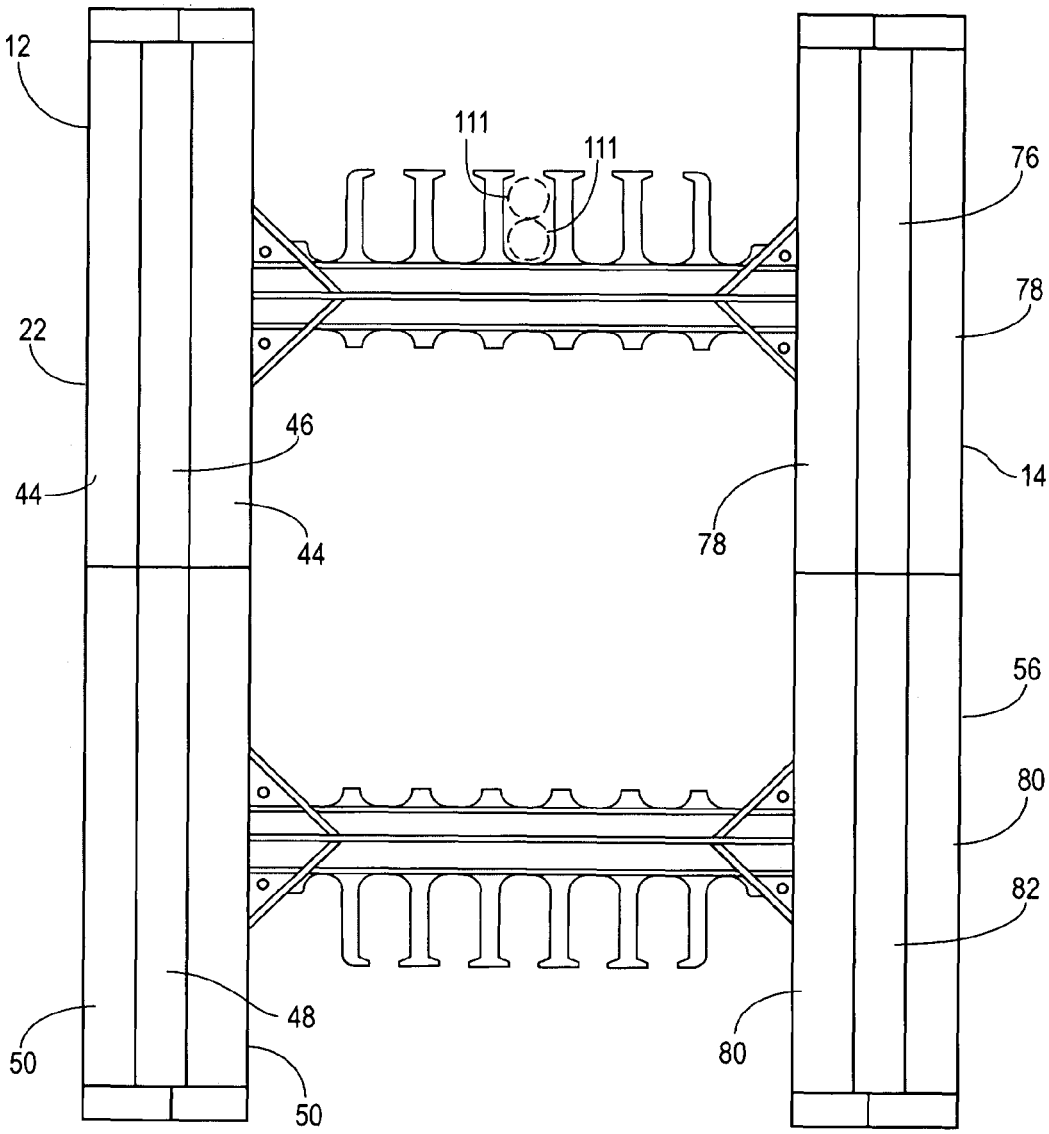
FIG. 4 is an end elevational view of the insulating concrete block of FIG. 1.

As shown in FIG. 4, the first end 22 of the panel 12 is provided with a tongue and groove pattern that allows for a mating interconnection with the end of another panel. More specifically, the first end 22 of the panel 12 has an upper pair of projections 44 spaced apart to form a recess 46 and a lower projection 48 defining a pair of recesses 50 on each side thereof. Similarly, the second end 24 of the panel 12 is formed to have projections and recesses. However, the projections and recesses on the second end 24 are offset relative to the first end 22 wherein a recess on the second end 24 opposes a projection on the first end 22 and a projection on the second end 24 opposes a recess on the first end 22. In a preferred version, the projections of the first and second ends 22 and 24 are provided with a shallow profile to permit the first and second ends 22 and 24 of the panel 12 to abut the end of another panel that may not have a corresponding tongue and groove pattern. For example, if a block is vertically cut, it is still desirable that the first and second ends abut a smooth end surface. To this end, a preferred height of the projections is approximately 1 mm.

Referring again to FIG. 2A and 2B, the panel 14 has a top end 52, a bottom end 54, a first end 56, and a second end 58. The top end 52 has an outside row of a plurality of projections 60 which are spaced apart to define a plurality of corresponding recesses 62 and an inside row of projections 64 and 64*a* which are spaced apart to define a plurality of recesses 66. The projections 64 and 64*a* of the inside row are different in size to one another and are alternated relative to one another. Moreover, the projections 64 and 64*a* of the inside row are each different in size to the projections 60 of the outside row.

The bottom end 54 of the panel 14 also has an outside row of alternating projections 68 and recesses 70 and an inside row of alternating projections 72 and 72*a* and recesses 74. However, the projections and recesses along the bottom end 54 of the panel 14 are offset relative to the top end 52 wherein a recess on the bottom end 54 opposes a projection on the top end 52 of corresponding size and a projection on the bottom end 54 opposes a recess on the top end 52 of corresponding size with the exception that the recesses of the inner rows are sized to received either of the projections of the inner row.

The first end 56 of the panel 14 is formed to have a tongue and groove pattern that allows for a mating interconnection with the end of another panel. More specifically, the first end 56 of the panel 14 has an upper projection 76 defining a pair of recesses 78 on each side thereof and a lower pair of projections 80 spaced apart to form a recess 82. Like the first end 56, the second end 58 of the panel 14 is formed to have projections and recesses. However, the projections and recesses on the second end 58 are offset relative to the first end 56 wherein a recess on the second end 58 opposes a projection on the first end 56 and a projection on the second end 58 opposes a recess on the first end 56. In a preferred version, the projections of the first and second ends 56 and 58 are provided with a shallow profile to permit the first and second ends 56 and 58 of the panel 14 to abut the end of another panel that may not have a corresponding tongue and groove pattern. For example, if a block is vertically cut, it is still desirable that the first and second ends abut a smooth end surface. To this end, a preferred height of the projections is approximately 1 mm.

The panels 12 and 14 can be formed from fire retardant expanded polypropylene, polystyrene, polyethylene or other suitable polymers with expanded polystyrene commonly referred to as "EPS" being preferred. Subject to indentations and protrusions of minor dimensions, which can be any structure used to connect the forms together vertically to form a wall as discussed below, the panels are of generally uniform rectangular cross-section. In a typical case, each panel may be 48 inches long, 16.50 inches high, and 2.50 inches thick. However, it will be appreciated that the panels may constructed in a variety of shapes and sizes.

The panels 12 and 14 are assembled with the web structures 16 of desired dimension so that the outside rows are adjacent the outside of the block 10 and the inside rows are adjacent the inside of the block 10. In addition to the projections and recesses of the outside and inside rows alternating in the longitudinal direction, the projections and recesses alternate across the top end and the bottom end going from one panel 12 to the other panel 14. Similarly, the projections and recesses of the first and second ends of the panels 12 and 14 alternate going from the panel 12 to the panel 14. The projections and recesses permit the stacking and interconnection of a plurality of like blocks 10 as would be required in the construction of a wall or similar arrangement. Projections and recesses of the block 10 are substantially symmetrical, thereby permitting the interconnection of like blocks in a bi-directional and/or reversible manner.

Figure 6:
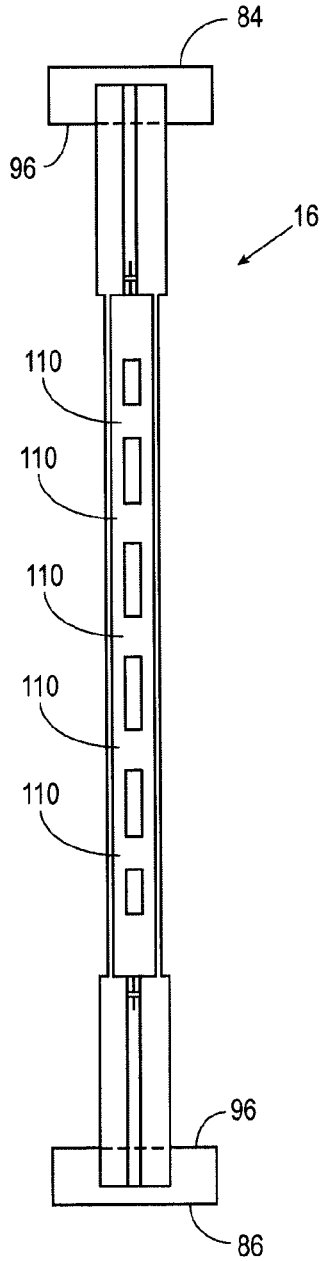
FIG. 6 is a top plan view of the web structure.
Figure 5:
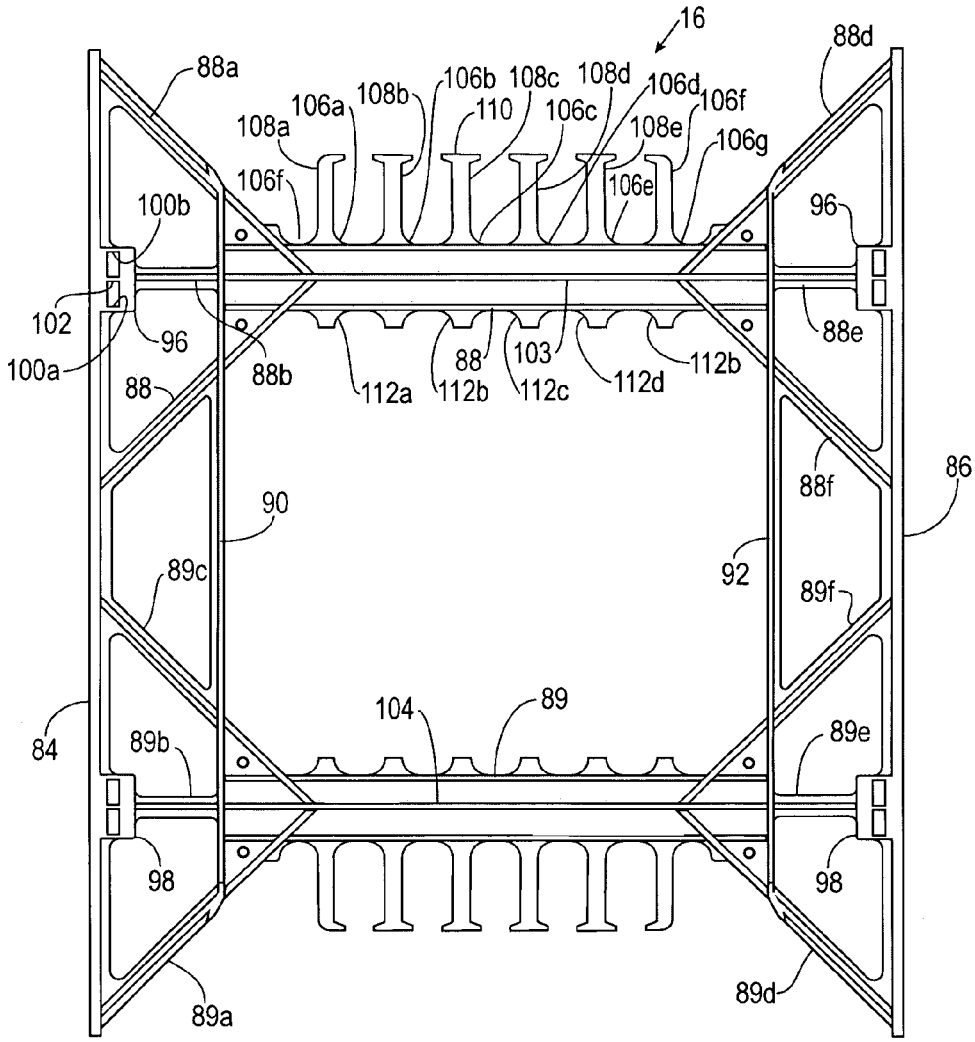
FIG. 5 is an elevational view of a web structure used in the insulating concrete block of FIG. 1.

Referring now to FIGS. 5 and 6, each web structure 16 may be formed from a single integral unit molded of plastic, with the preferred plastic being high-density flame retardant polypropylene, although flame retardant polyethylene, polystyrene and other suitable polymers may be used. The web structure 16 includes a pair of elongated end plates 84 and 86 joined by a pair of substantially identical web members 88 and 89, which are generally symmetrically disposed above and below a central horizontal axis of the web structure 16.

The end plates 84 and 86 are preferably recessed into the panels 12 and 14 such that their outer surfaces are set back a distance from the exterior surfaces of panels 12 and 14, respectively. However, the end plates 84 and 86 may be positioned such that the end plates 84 and 86 are substantially flush with the exterior surfaces of the panels 12 and 14. End plates 84 and 86 are oriented in the top-to-bottom or vertical direction relative to the panels 12 and 14 as they would be positioned in use in a vertical wall.

The web structure 16 further includes a pair of strip members 90 and 92 oriented in the top-to-bottom direction of the panels 12 and 14 and are symmetrically disposed on opposite sides of a central vertical axis of the web structure 16 (when each panel has the same width). The strip members 90 and 92 lie in planes that are generally parallel to the end plates 84 and 86 and perpendicular to the plane of the web members 88 and 89. Each of the strip members 90 and 92 has opposite ends that curve outwardly toward end plates 84 and 86, respectively. The function of the strip members 90 and 92 is to assist in positioning the web structure 16 in the molds before the foam material is injected into the molds to form foam panels 12 and 14, and also help to seal against the flow of foam beyond the desired inner surfaces of panels 12 and 14, respectively.

Web structures 16 preferably are molded into the panels 12 and 14 in the course of producing the panels 12 and 14 such that opposite end portions of the web structures (including the end plates and portions of the web members) are encased within the foam making up the panels 12 and 14. In the block 10, strip member 90 abuts against and is flush with the inner surface of the panel 12 and strip member 92 abuts against and is flush with the inner surface of panel 14. End plates 84 and 86 may be of substantially equal height as the panels 12 and 14 and may be substantially flush with the top and bottom ends of the panels, which does require them to extend completely to the ends. In fact, it is preferred for the end plates 84 and 86 to stop a short distance from the top and bottom ends of the panels 12 and 14 to facilitate connection and stacking of the blocks 10 to build a wall to facilitate the installation of wiring and plumbing after concrete is poured into the blocks 10.

The blocks 10 are preferably stacked when building a wall so that the end plates 84 and 86 are vertically aligned to form continuous furring strips for attaching finishing materials to the completed wall. To this end, the end plates 84 and 86 are provided with attachment elements 96 and 98 which are formed by providing thickened areas on the end plates 84 and 86. More specifically, the attachment elements 96 and 98 are in the form of boss like blocks extending inwardly a distance from the end plates 84 and 86 and extending the width of the end plates 84 and 86. The attachment elements 96 and 98 may be formed of any desired thickness so long as the attachment elements 96 and 98 are sufficiently thick to hold a selected fastener. To facilitate the manufacture of the web structure 16, the attachment elements 96 and 98 are provided with voids 100*a* and 100*b* separated by a brace 102.

The attachment elements 96 and 98 are spaced on 8 inch intervals vertically, thereby allowing one to fasten screws or gun nails to it with superior holding power over the balance of the web face. The positioned of the web structure 16 in the panels 12 and 14 further causes the attachment elements 96 and 98 to be spaced vertically on eight inch intervals with the attachment elements of adjacently stacked panels. As will be described below, the locations of the attachment elements 96 and 98 are marked on the exterior face of the panels 12 and 14. This facilitates the attachment of bracing during the installation process, hanging of cabinets, precious pictures or other items that need a more secure holding area with far superior strength than otherwise possible with other webs. Of course, one of ordinary skill in the art will recognize that alternative embodiments of the invention include the end plates being completely buried within the foam panels 12 and 14, or being partially buried, in which case, portions of the end plates would be exposed, such as by the formation of openings through the foam panels, as is known in the art. The end plates could also extend above and/or below the top and bottom of the panels.

The upper web member 88 has three diverging legs 88*a*, 88*b*, and 88*c* extending from a cross member 103 toward the end plate 84. Diverging leg 88*a* merges with the end plate 84 near the upper end of the end plate 84. Diverging leg 88*b* merges with the attachment element 96 to support the attachment element 96. Diverging leg 88*c* merges with end plate 84 at its distal end near the center of the end plate 84. On the opposite side of the vertical axis diverging legs 88*d*, 88*e*, and 88*f* merge with end plate 86 in a similar fashion.

Web structure 16 is substantially symmetrical about horizontal axis such that lower web member 89 similarly includes diverging legs 89*a*, 89*b*, and 89*c* extending from cross member 104 and merging with end plate 84 and diverging legs 89*d*, 89*e*, and 89*f* that merge with end plate 86. As a result, the web members 88 and 89 are spaced approximately every eight inches, by way of example, when stacked vertically. This allows the blocks or forms when cut in half horizontally to be identical as well as having the cross member extend through the middle with equal distance from top or bottom once stacked with other blocks or forms. This gives equal strength to the bottom and top of the ½ size cut block or form.

The outward facing sides of the cross members 103 and 104 are formed to have a series of seats for rebar positioning. More particularly, seats 106*a*, 106*b*, 106*c*, 106*d*, and 106*e* are defined by restraining fingers 108*a*, 108*b*, 108*c*, 108*d*, 108*e*, and 108*f*, respectively, while seats 106*f* and 106*g* are partially defined by restraining fingers 108*a* and 108*f*, respectively. The distal end of each of the restraining fingers is provided with a flange 110 and the restraining fingers are laterally flexible to permit insertion of the rebar in the seats. As shown, the seats are preferably dimensioned to receive at least two pieces of rebar 111 in a vertical orientation as illustrated in FIG. 4, thereby eliminating the need to tie overlapping sections of rebar together.

The inner sides of the cross members 102 and 104 are formed to have seats in the form of saddles 112*a*, 112*b*, 112*c*, 112*d*, and 112*e*. By omitting the restraining fingers, the saddles on the inner side of the cross members 102 and 104 permit better flow of the concrete through the block 10 during the concrete pouring process. The saddles 112*a*, 112*b*, 112*c*, 112*d*, and 112*e* are used to hold rebar in place if the block 10 is cut in half horizontally to make half height blocks.

Figure 7:
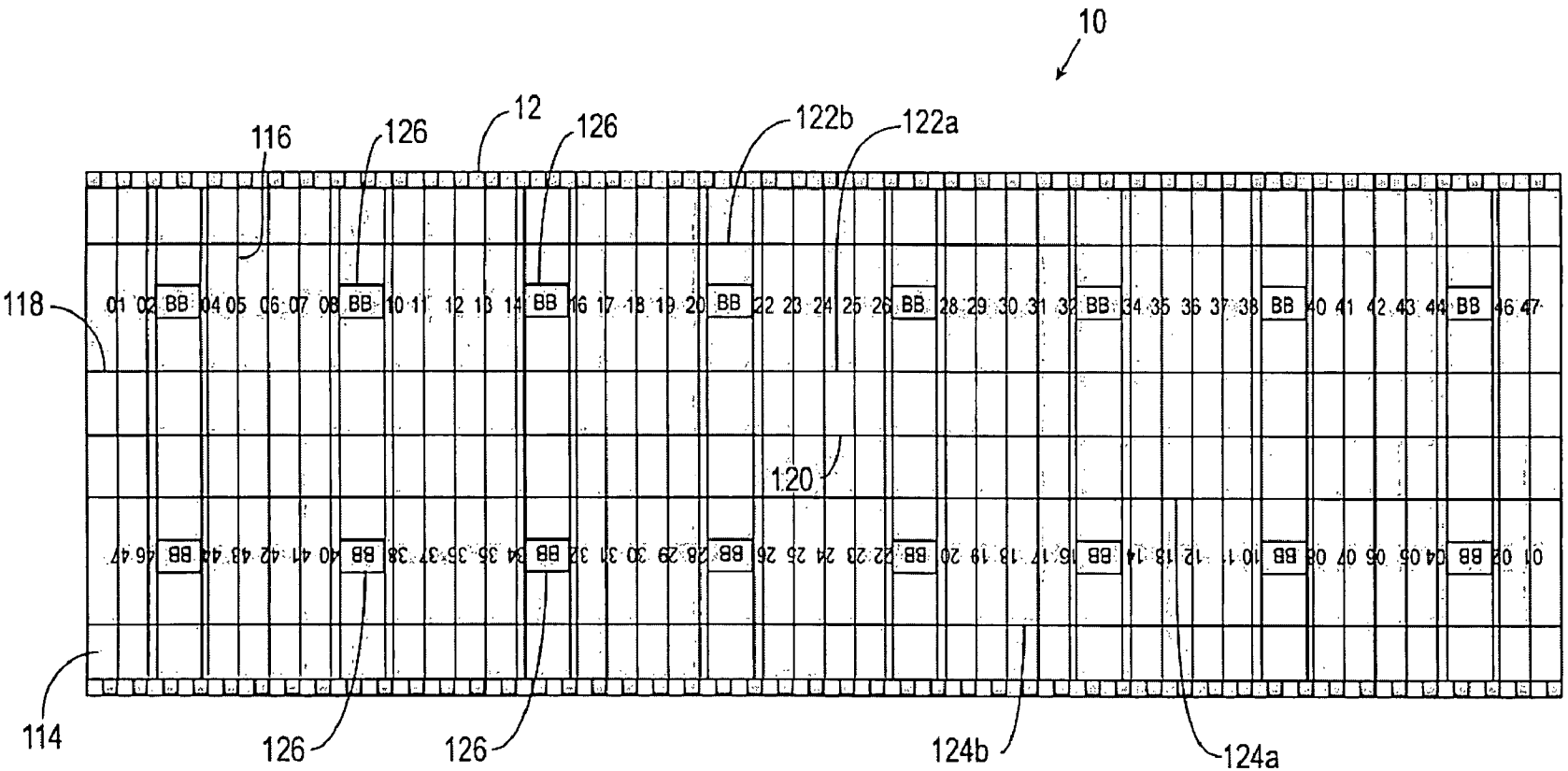
FIG. 7 is a side elevational view of the insulating concrete block of FIG. 1.

FIG. 7 illustrates an exterior face 114 of the panel 12. The exterior face 114 is provided with a series of vertical markings 116 and horizontal markings 118 to serve as guidelines for assisting the installer to cut the block 10 to a desired size. The vertical markings 116 are preferably spaced at one inch intervals; however, it will be appreciated that other intervals may be used. In addition, the vertical markings 116 are identified with numerals much like a measuring tape. This allows an installer to cut blocks many times without the need of marking the cut point on the block, or many times eliminating the need to measure the form during the installation or cutting process of installation. This will save time and money during the installation process.

The horizontal markings 118 include a center line 120, a pair of upper lines 122*a* and 122*b*, and a pair of lower lines 124*a* and 124*b*. These horizontal lines 118 are spaced every 2 inches from the center line 120. This allows an installer making horizontal cuts to have a line to follow for cutting straight whether they cut directly on the line or not.

The panels 12 and 14 further includes a series of markings 126 indicating the position of the web structures 16, and in particular the attachment element 96 and 98 of the end plates 84 and 86.

Figure 8:
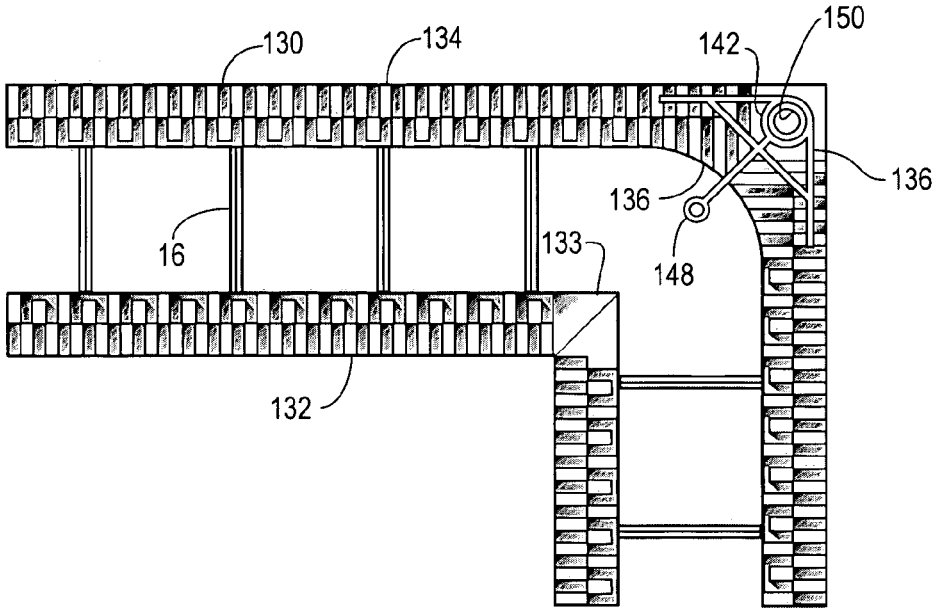
FIG. 8 is a top plan view of a corner insulating concrete block constructed in accordance with the present invention.
Figure 9:
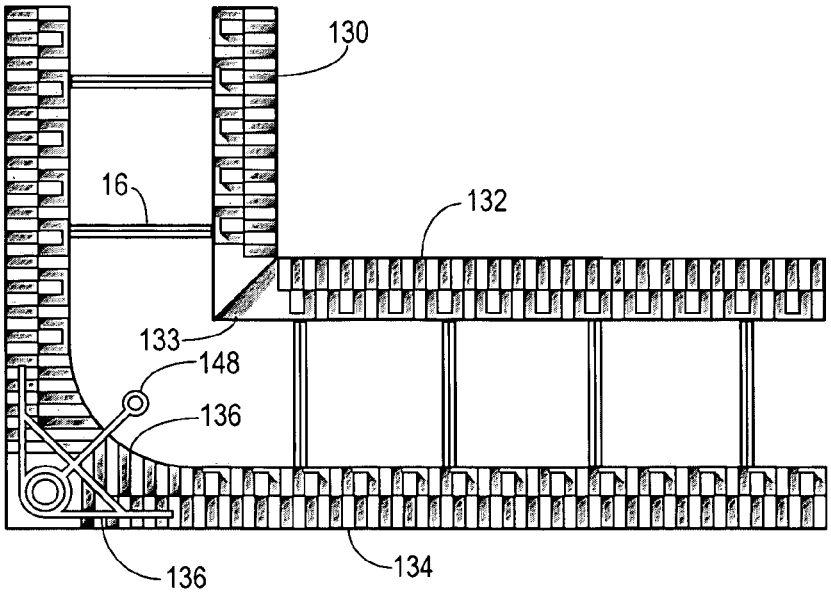
FIG. 9 is a bottom plan view of the corner insulating block of FIG. 8.

FIGS. 8-10 illustrate a 90 degree corner block 130 constructed in accordance with the present invention. The corner block 130 includes an inner panel 132 defining a corner 133 and an outer panel 134 defining a corner 135 interconnected to one another with a plurality of web structures 16. A corner web 136 is positioned in the corner 136 of the outer panel 134 so that upon cutting the corner block 130 in half horizontally, the corner web 136 is cut in half allowing one half of the web to remain in each half of the block for attaching items to it.

Figure 10A:
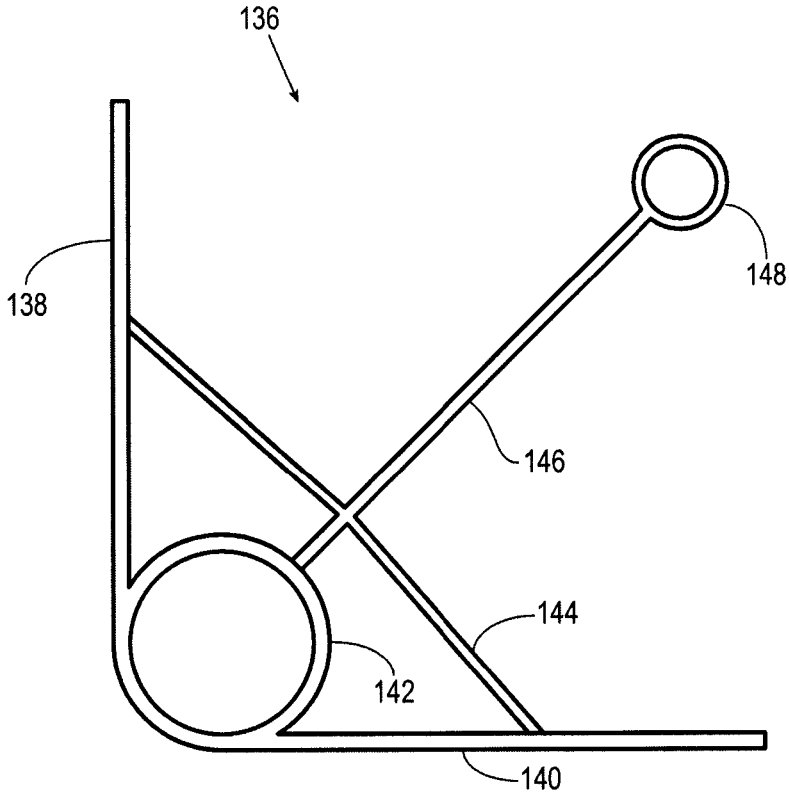
FIG. 10A is a top plan view of a corner web constructed in accordance with the present invention.
Figure 10B:
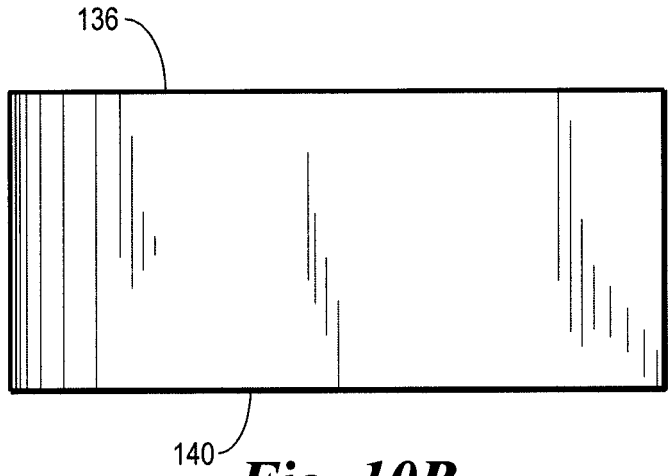
FIG. 10B is a side elevational view of the corner web of FIG. 10A.

As best shown in FIGS. 10A and 10B, the corner web 136 is a substantially L-shaped member with a first leg 138 and a second leg 140. A tube 142 is formed on the inner side of the intersection of the first leg 138 and the second leg 140. The first leg 138 is additionally connected to the second leg 140 with a brace 144. An extension member 146 extends from the tube 142, intersects the brace 144 and extends outward from the brace 144. A tube 148 is formed at the distal end of the extension member 146. The extension member 146 is dimensioned so that the tube 148 is positioned in the concrete receiving cavity between the inner panel 132 and the outer panel 134. The tube 148 is dimensioned to receive rebar which is to be placed vertically through the tubes 148 of each of the stacked corner blocks 130. As such, horizontally positioned rebar may be wrapped around the back side of the vertical rebar if needed every block course to help stabilize the corner blocks. Thus, the corner block 130 is tied to the blocks 10 and eliminates the corner blocks 130 from pulling away from the stacked blocks 10 during the concrete pouring process. The need for significant strapping on the corner blocks 130 is also eliminated thus saving installation labor costs and costly damage to the corner from pulling away from the wall.

In forming the outer panel 134, a hole 150 is formed which is aligned with the tube 142. The hole 150 and the tube 142 are sized to allow a piece of pipe, such as a standard ¾ inch schedule 40 PVC pipe, to be placed vertically through the hole 150 and the tube 142 when the corner blocks 130 are stacked. This allows a vertical attach point for fastening items to the pipe the entire length of the stacked corner of the corner blocks 130. This also prevents the stacked corner blocks 130 from pulling away from the other corner blocks or the blocks 10.

Figure 11:
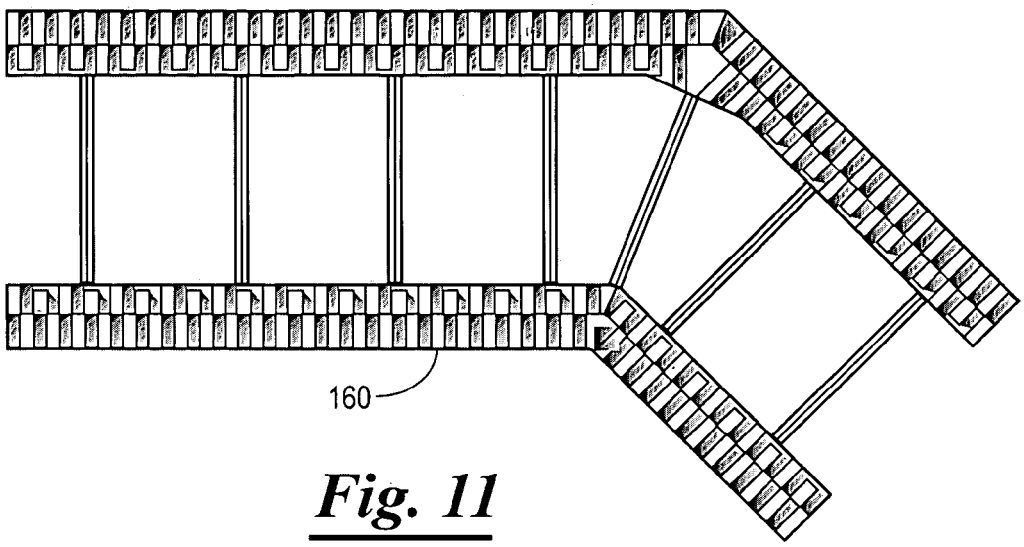
FIG. 11 is a top elevational view of another embodiment of a corner insulating block constructed in accordance with the present invention.
Figure 12:
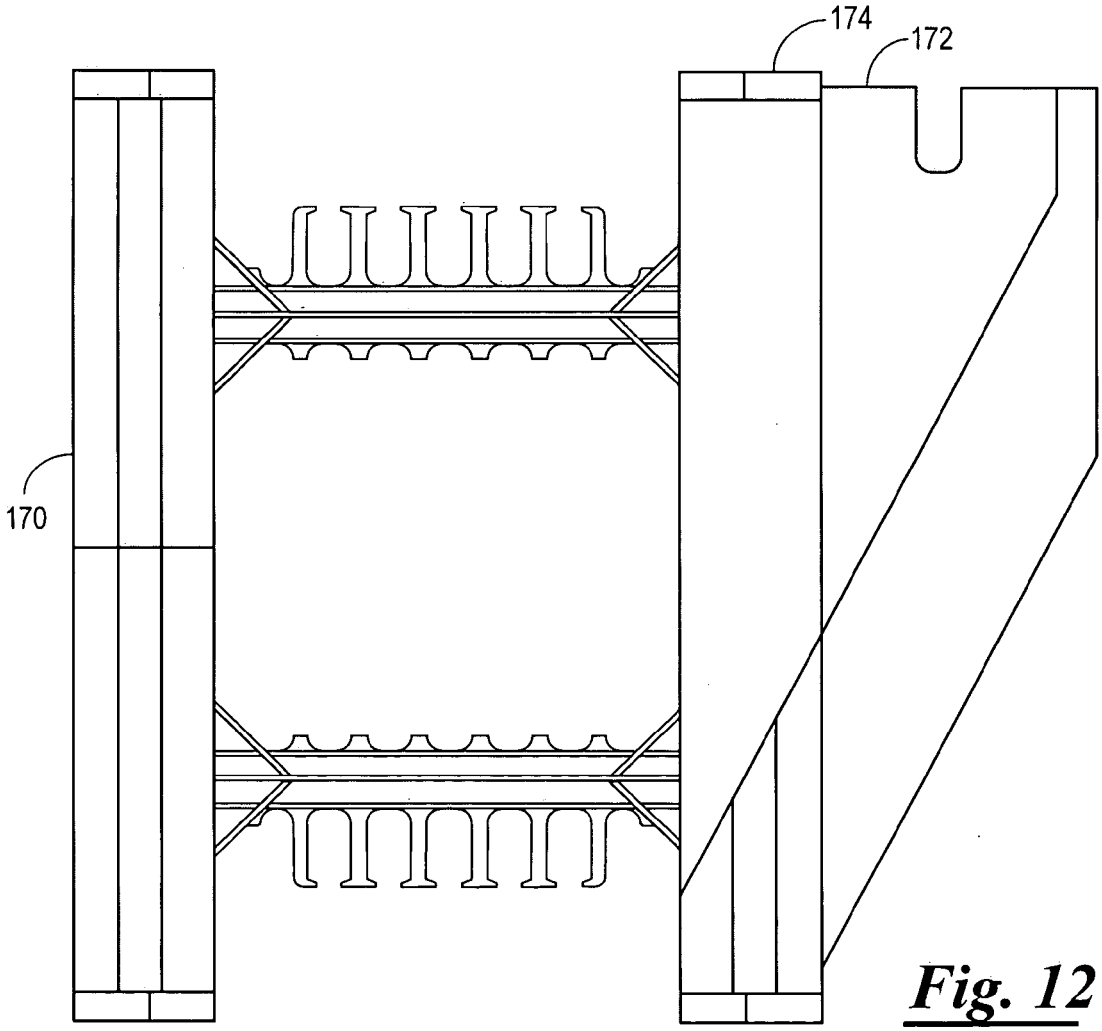
FIG. 12 is an end elevational view of a ledge block constructed in accordance with the present invention.

FIG. 11 illustrates a 45 degree corner block 160 constructed in accordance with the present invention.

Figure 13:
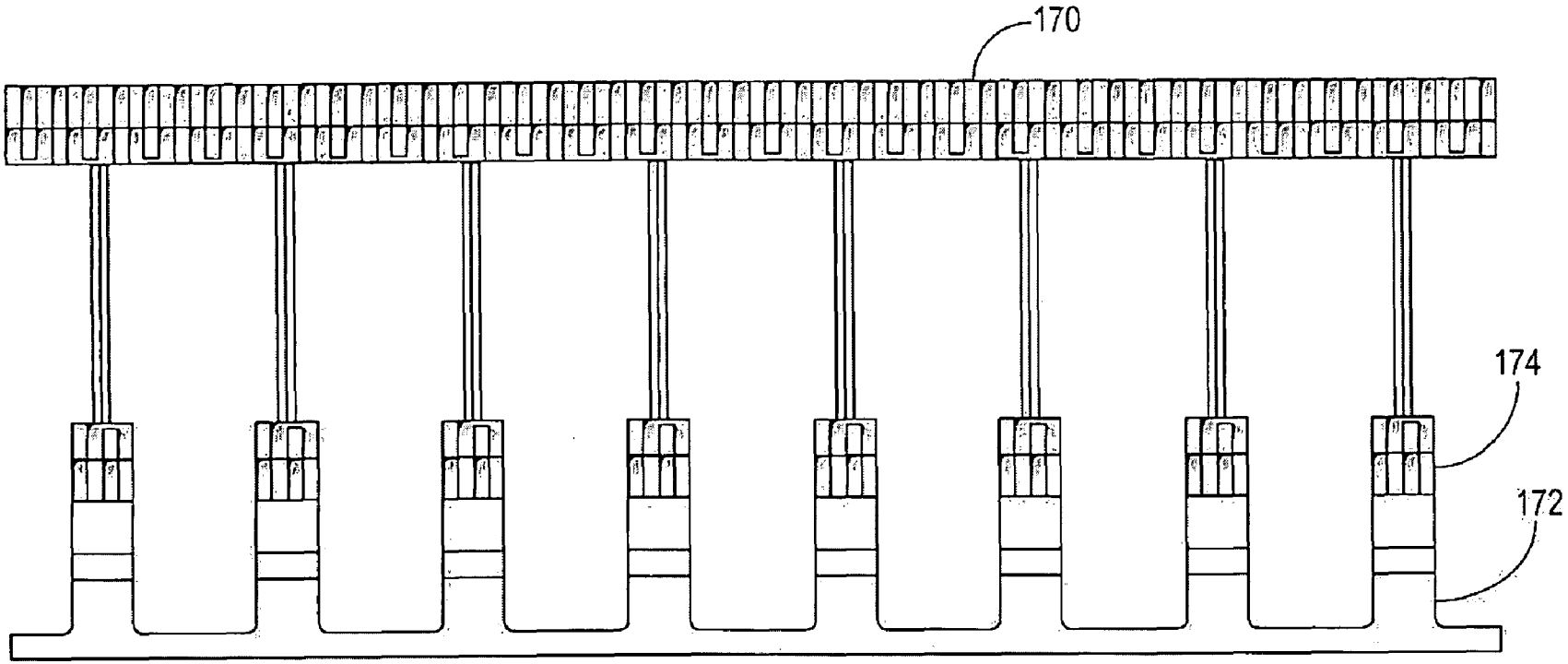
FIG. 13 is a top elevational view of the ledge block of FIG. 12.

FIGS. 13-14 illustrate a ledge block 170 constructed in accordance with the present invention. The ledge block 170 includes a brick ledge 172 extending outwardly of the outer row of projections 174.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed herein.

What is claimed is:

1. A construction member adapted to be interconnected with other construction members to form an insulating concrete form for casting concrete, the construction member comprising:

a foam panel having a top end, a bottom end, a first end, and a second end, the top end and the bottom end of the panel having an outside row of a plurality of projections and an inside row of a plurality of projections, the projections of the outside row being spaced apart to define a plurality of recesses and the projections of the inside row being spaced apart to define a plurality of recesses with the projections of the outside row being adjacent to the recesses of the inside row and the recesses of the outside row being adjacent the projections of the inside row, each projection and recess of the top end of the panel being opposed respectively to one of the recesses and one of the projections of the bottom end of the panel whereby the panel is interconnectable with a like panel in a bidirectional or reversible manner, wherein a plurality of the projections of the inside row are set back from an inner edge of the panel and a plurality of the projections of the inside row are flush with the inner edge of the panel such that when the panel is interconnected to a like panel, a plurality of spaced apart recesses are formed along an inner face defined by the interconnected foam and like panels.

2. The construction member of claim 1 wherein adjacent ones of the projections of the inside row are different in size to one another.

3. The construction member of claim 2 wherein each of the projections of the inside row are different in size to the projections of the outside row.

4. The construction member of claim 3 wherein each of the projections of the inside row are smaller in size than the projections of the outside row.

5. An insulating concrete form block adapted to be interlocked with other insulating concrete form blocks to form an insulating concrete form for casting concrete, the insulating concrete form block comprising:

a first foam panel and a second foam panel supported in a spaced apart, parallel relationship to form a concrete receiving cavity, each of the first panel and the second panel having a top end, a bottom end, a first end, and a second end, the top end and the bottom end of each of the first and second panels having an outside row of a plurality of projections and an inside row of a plurality of projections, the projections of the outside rows being spaced apart to define a plurality of recesses and the projections of the inside rows being spaced apart to define a plurality of recesses with the projections of the outside rows being adjacent to the recesses of the inside rows and the recesses of the outside rows being adjacent the projections of the inside rows, each projection and recess of the top end of the first panel being opposed respectively to one of the recesses and one of the projections of the bottom end of the first panel and facing one of the recesses and one of the projections of the second panel and each projection and recess of the top end of the second panel being opposed respectively to one of the recesses and one of the projections of the bottom end of the second panel and facing one of the recesses and one of the projections of the first panel, whereby the first and second panels are interconnectable with a like pair of panels in a bidirectional or reversible manner, wherein a plurality of the projections of the inside row of the first panel are set back from an inner edge of the first panel and a plurality of the projections of the inside row of the first panel are flush with the inner edge of the first panel and wherein a plurality of the projections of the inside row of the second panel are set back from an inner edge of the second panel and a plurality of the projections of the inside row of the second panel are flush with the inner edge of the second panel such that when the first and second panels are interconnected with a like pair of panels a plurality of spaced apart recesses are formed along an inner face defined by the interconnected first, second, and like pair of panels.

6. The block of claim 5 wherein adjacent ones of the projections of the inside rows of each of the first and second panels are different in size to one another.

7. The block of claim 6 wherein each of the projections of the inside rows of the first and second panels are different in size to the projections of the outside rows of the first and second panels.

8. The block of claim 7 wherein each of the projections of the inside rows of the first and second panels are smaller in size than the projections of the outside rows of the first and second panels.

9. The block of claim 5 wherein each of the projections and the recesses has a length and a width and wherein the shape of the projections and the recesses of each panel is generally rectangular with the length being greater than the width.

10. The block of claim 5 wherein at least one of the panels includes a ledge extending outwardly of the outer row of projections.

11. An insulating concrete form block adapted to be interlocked with other insulating concrete form blocks to form an insulating concrete form for casting concrete, the insulating concrete form block comprising:

a first foam panel and a second foam panel supported in a spaced apart, parallel relationship to form a concrete receiving cavity, each of the first panel and the second panel having a top end, a bottom end, a first end, and a second end, the top end and the bottom end of each of the first and second panels having an outside row of a plurality of projections and an inside row of a plurality of projections, the projections of the outside rows being spaced apart to define a plurality of recesses and the projections of the inside rows being spaced apart to define a plurality of recesses with the projections of the outside rows being adjacent to the recesses of the inside rows and the recess of the outside rows being adjacent projections of the inside rows, each projection and recess of the top end of the first panel being opposed respectively to one of the recesses and one of the projections of the bottom end of the first panel and facing one of the recesses and one of the projections of the second panel and each projection and recess of the top end of the second panel being opposed respectively to one of the recesses and one of the projections of the bottom end of the second panel and facing one of the recesses and one of the projections of the first panel, whereby the first and second panels are interconnectable with a like pair of panels in a bidirectional or reversible manner, wherein adjacent projections of the inside rows of the first and second panels are different in size to one another and wherein each of the projections of the inside rows of the first and second panels are different in size to the projections of the outside rows of the first and second panels.

12. The block of claim 11 wherein each of the projections of the inside rows are smaller in size than the projections of the outside rows.

13. The block of claim 12 wherein each of the projections and the recesses has a length and a width and wherein the shape of the projections and the recesses of each panel is generally rectangular with the length being greater than the width.

* * * * *